US006691904B2

(12) United States Patent
Pineda

(10) Patent No.: US 6,691,904 B2
(45) Date of Patent: Feb. 17, 2004

(54) ID BADGE LANYARD COMBINATION NECKTIE HOLDOWN APPARATUS

(75) Inventor: Gerardo Pineda, 7 Morning Breeze Ct., Silver Spring, MD (US) 20904

(73) Assignee: Gerardo Pineda, Silver Spring, MD (US)

( * ) Notice: Subject to any disclaimer, the term of this patent is extended or adjusted under 35 U.S.C. 154(b) by 73 days.

(21) Appl. No.: 10/080,946

(22) Filed: Feb. 25, 2002

(65) Prior Publication Data

US 2003/0160074 A1 Aug. 28, 2003

(51) Int. Cl.[7] ..... D06C 15/00
(52) U.S. Cl. ..... 223/81; 24/66.2
(58) Field of Search ..... 223/81; 24/66.2, 24/66.8, 65, 3.4, 66.13, 49.1, 50, 52, 66.9; 446/27; 2/145; D11/95

(56) References Cited

U.S. PATENT DOCUMENTS 2,024,085 A * 12/1935 Baer ..... 40/618
2,024,943 A * 12/1935 Mix ..... 24/66.2
2,079,521 A * 5/1937 Mix ..... 24/66.2
2,192,379 A * 3/1940 Inqleby ..... 24/66.2
2,510,286 A * 6/1950 Johnson ..... 24/66.11
2,713,706 A * 7/1955 Biagi ..... 24/66.2
3,319,305 A * 5/1967 Anderson ..... 24/66.11
3,609,823 A * 10/1971 Boots ..... 24/66.2
4,262,393 A * 4/1981 Neri ..... 24/66.2
5,052,083 A * 10/1991 Hammer ..... 24/66.2

* cited by examiner

*Primary Examiner*—John J. Calvert
*Assistant Examiner*—James G Smith
(74) *Attorney, Agent, or Firm*—Gerardo Pineda

(57) ABSTRACT

A loop lanyard adapted as a necktie hold-down, to display on a person, identification card mediums, for public view. The identification card medium-mounting element, placed on the smaller lanyard loop on the bottom end, may be in the form of a clasp, ring, clip, or pressure closed hook to accommodate various ID Card eyelet designs. A clothing attachment clip is affixed to the rigid portion at the top end of the lanyard loop for attachment to the shirt opening directly behind the necktie. The loop lanyard cord is designed in a manner such having a rigid support element integrated at the top where the clothing clip is affixed to maintain the integrity of the shape of the necktie width. The loop lanyard is inserted through a decorative bead to create a smaller loop where the ID card mounting medium is located. The decorative bead will allow for an adjustment by sliding the right or left side of the lanyard up or down, to maintain the ID card centered on the front portion of the necktie. The necktie when placed through the larger lanyard loop will allow the identification card secured on the medium to be displayed.

5 Claims, 5 Drawing Sheets

4 A

4 B

ID BADGE LANYARD COMBINATION NECKTIE HOLDOWN APPARATUS

BACKGROUND OF THE INVENTION

1. Field of the Invention

This invention relates to an off-centered figure eight lanyard loop design assembly with an integrated rigid support unit on top, adapted as a necktie hold-down, to display identification badges. The apparatus is attached, with an attachment clip, to the front of the shirt directly behind the necktie and, further explained, by inserting the necktie through the larger loop of the assembly will display on top of the front of the necktie, various identification medium attached at the smaller loop of the assembly located at the lower end of the apparatus.

2. Discussion of the Related Art

There are various types of products that secure identification medium such as individual photo cards, pass-thru electronic cards etc . . . , which are generally designed to be secured to a lanyard and either be worn around some part of the human body or attached to clothing allowing for immediate public display. Different types of devices for securing the cards to the lanyards exist and are known in the art. It is the object of this invention to provide a different lanyard design for means to secure the identification medium to an individual for public display adapted for use as a necktie hold-down apparatus.

Law enforcement officers, security oriented individuals, members of organizations, private and public entities, corporations and the like, currently utilize, among other mediums known to the art, a lanyard designed to be worn around the neck or a clip designed to be directly attached to clothing. I believe that the use of a lanyard, particularly around the neck continues to be a safety issue in case of confrontations with suspects or the item being caught on doorknobs or drawers by accident. Granted, there exists a Breakaway Lanyard, U.S. Pat. No. 5,092,018 issued to S. M. Seron, to prevent accidental injury. My invention is not to be worn around any part of the human body.

Individuals associated with security oriented parameters, generally are required to wear some form of identification medium generally visible, without hampered from view by clothing, to the public when employed or for access to restricted areas such as airports, businesses, government buildings etc. . . . This invention will allow individuals to comply with those security identification requirements and provide a quick means to conceal the identification medium, at the wearer's discretion, by pulling out the necktie from the lanyard loop and placing the necktie over and covering the ID Card without the necessity of disconnecting the lanyard from the shirt for placement inside a pocket.

BRIEF SUMMARY OF THE INVENTION

It is the principle idea of this invention to provide a different designed lanyard assembly, for the security, safety and fashion conscious individual, to publicly display identification card medium adapted to serve as a hold down for a standard necktie.

In the principle exemplary design of the invention, disclosed is a lanyard which includes a strap, currently available in either flat or hollow design, being of a loop created by securing together both adjacent ends to a rigid support element. This connection is for the purpose of providing a rigid support property limited only to that portion of the loop forming the top part of the lanyard assembly and when worn, is covered by the necktie. The support mechanism is made of a rigid material such as plastic or metal strips, attached to the lanyard loop by small grommet hardware and/or adhesive. A clothing attachment clip is found attached by small grommet hardware to the rigid portion of the support mechanism located and making up the top portion of the lanyard loop assembly. The lanyard assembly is then threaded through a hollow bead unit placing the bead just above the identification card mounting medium at the bottom. The purpose of the hollow bead unit is to allow for an up and down adjustment of either left or right side of the lanyard to insure that the identification card mounting medium is kept centered over a necktie.

The identification-mounting medium is placed on the bottom end portion of the lanyard loop assembly, located in the smaller loop that was created naturally by the hollow bead unit. The smaller loop is designed to host a plurality of identification card medium connectors. These connectors are available in a wide variety of sizes and shapes for the easement in the removal and attachment of cards of sorts. In one type of the embodiment, the connector may be simply a self-locking ring. In addition, an alternate connector may be a self-pressure closed hook. Still further, the connector embodiment may be in the form of a clothing attachment type clip.

Advantages and features of this invention description will be provided for and apparent in the accompanying schematical drawings.

DETAILED DESCRIPTION OF THE INVENTION

Figure 1:
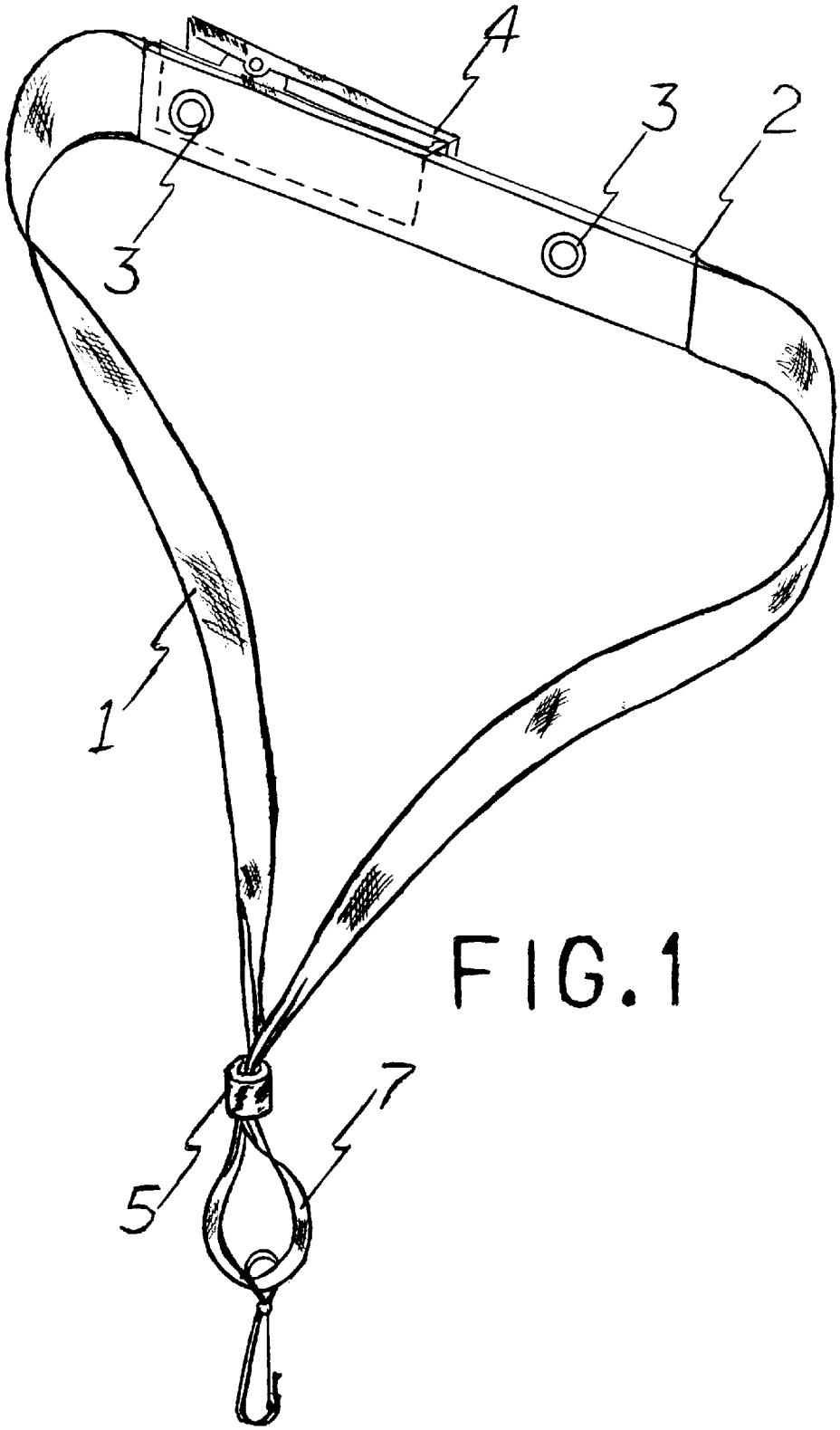
FIG. 1 is a perspective frontal view of the lanyard loop, off-centered figure eight adjustable with clothing attachment clip secured on the rigid portion, made according to the invention.
Figure 5:
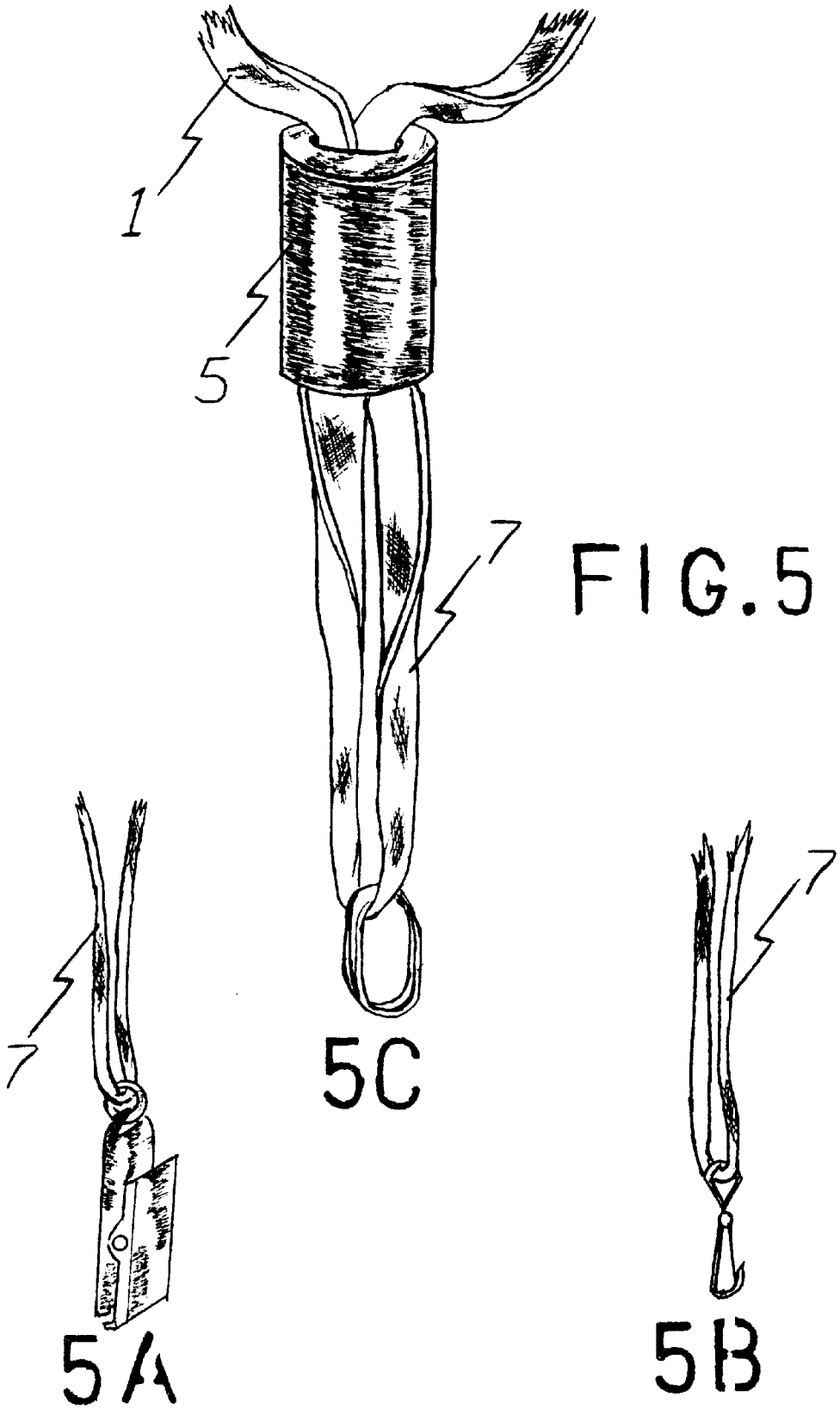
FIGS. 5(A)–(C) is a perspective view of the bottom portion of the smaller dimension loop created by the decorative bead and indicating a plurality of identification mounting medium that may be separately connected to the invention.

The following description and exemplary of the embodiment of the apparatus for identification document display is illustrated in FIG. 1 and is viewed as a lanyard loop 1 with a clothing attachment clip 4 mounted on the rigid portion 2 at the top, and a decorative hollow bead 5, of metal or plastic. The two adjacent ends of the strap are secured with the use of the rigid portion 2 located at the top. With both sides of the lanyard inserted through the decorative bead 5, naturally forming an additional smaller loop on the lower part of the lanyard loop portion capable of securing an identification card attachment type medium 6(A). It is understood that other types of mounting elements may be used in lieu of the hook or ring, such as but no limited to clip and ring combination FIGS. 5(A)–(C).

Figure 2:
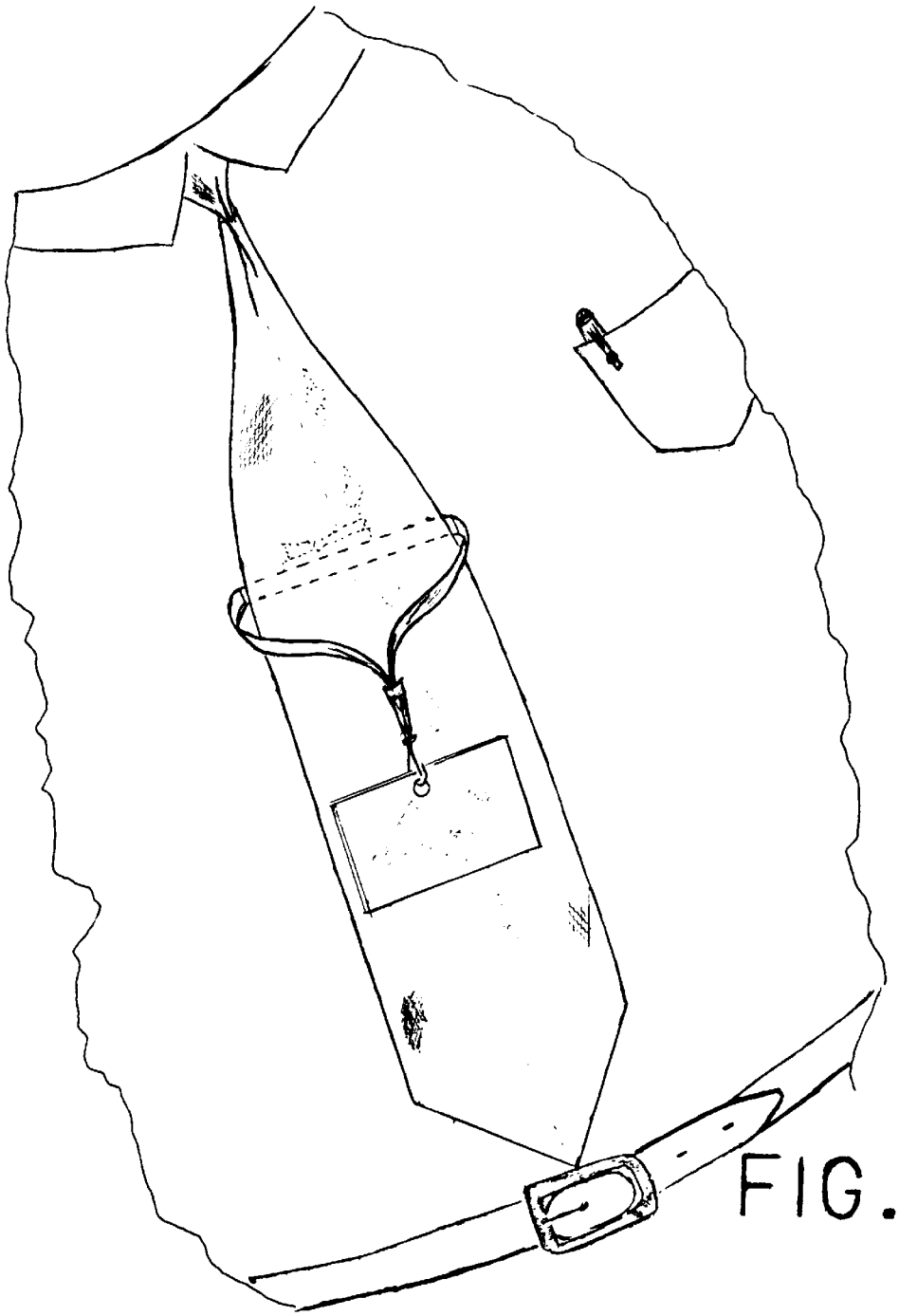
FIG. 2 Is a perspective view of the invention assembly with a necktie worn by the user.
Figure 3:
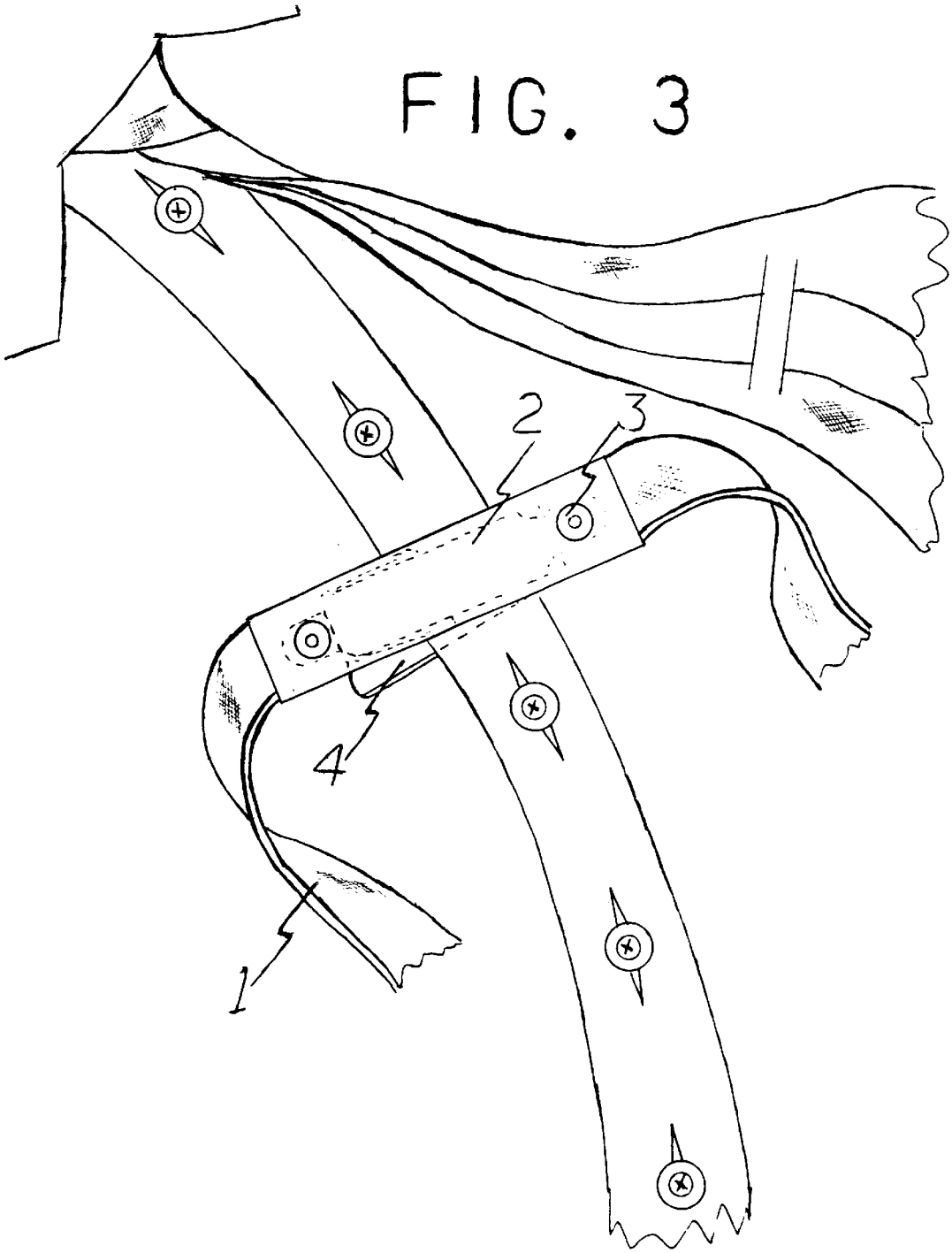
FIG. 3 Is a perspective view of the clothing attachment clip on the rigid portion of the loop clipped on to the shirt directly behind the necktie.
Figure 4:
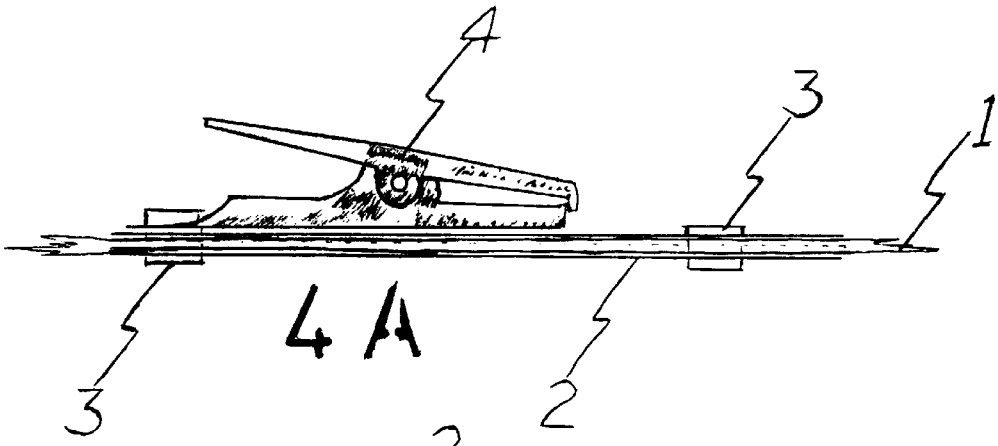
FIGS. 4(A)–(B) is a perspective view of the clothing attachment clip secured to the lanyard ends with a rigid member union.
Figure 4:
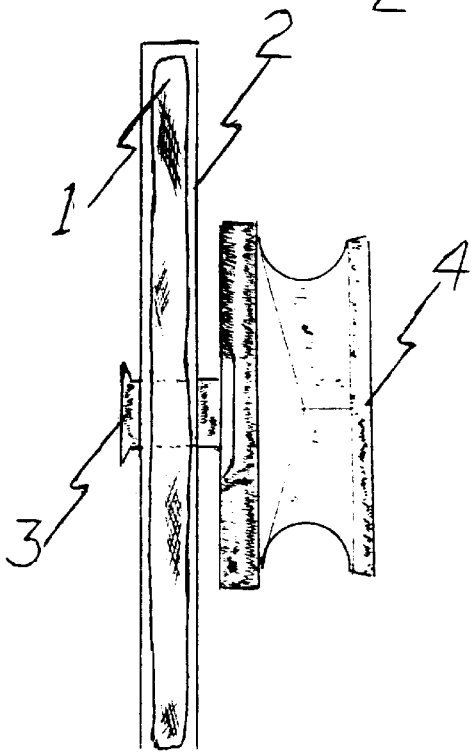

This invention is an apparatus that secures identification cards to persons clothing adapted as a necktie hold down. This invention will allow the user to display identification cards when placed over a necktie, as illustrated in FIG. 2 and; further, will allow for quick concealment of the identification card, at the users discretion, by placing the necktie directly over, and on top of the identification card(s) without the necessity of disconnecting the apparatus from the clothing.

This invention is an apparatus consisting of a common lanyard designed with each end connected together at the rigid portion 2 to form a loop 1 approximately sixteen inches in overall length. The material for the lanyard may be made of any type of suitable material, such as a woven or non-woven type fabric, either hollow or flat strap. In this embodiment, both ends are connected to a rigid member for stability that will form the top portion 2 of the loop 1, further connecting a clothing attachment clip 4. The rigid member may be flat or round, of material consisting of plastic or metal. This rigid member will be approximately four inches long (general width of a necktie) connected by means of grommets or other techniques may be employed for making this connection, such as adhesives or commercial grade staples. This connection, in its entirety will define the upper section of the lanyard loop 1. The permanent connection of the attachment clip 4 on to the rigid member 2 and the lanyard material, will be placed so as to insure that the gripping portion of the clothing attachment clip 4 is centered on the rigid member 2. That is to further state, that the grommet 3 will be placed off-center towards the end of the rigid member 2. This will insure that the apparatus when attached to the shirt opening is centered behind the necktie and with the placement of the decorative hollow bead 5, will further maintain that the apparatus remains centered on the front of the necktie.

The lower section of the apparatus is then inserted through the opening of a decorative hollow bead 5 unit. The hollow bead 5 unit may be of metal or plastic, commercially available in a variety of colors. This assembly will naturally create a smaller loop 7 at the bottom portion of the apparatus. The natural friction will allow for the up or down adjustment of the left or right side of the apparatus, through the decorative hollow bead 5 unit for centering the apparatus over the necktie.

An identification card attachment medium is to be secured on the smaller loop naturally created by the decorative bead 5 unit, on the bottom of the apparatus. The identification card attachment medium referred to in this instant description may consist of commercially available clips/attachments FIGS. 5(A)–(C), self-closing hooks or rings. The forthcoming is an exemplary discussion of the embodiments of the invention. Those familiar with and skilled in the art will certainly appreciate and recognize from the drawings and claims, that variations can be made to the applications of securing the identification medium to and invention, therein without departing from the scope of utilization, design and idea of this invention as claimed.

What I claim as my invention is:

1. A lanyard assembly adapted as a cravat holder, comprising a supporting bar, a shirt attaching clasp secured to said supporting bar, attaching clasp placed off-centered toward the leading end of said supporting bar, to securely grip the overlapping margin of a shirt front, said supporting bar securing both adjacent ends of the lanyard thus forming a closed loop, allowing for the placement of the cravat therethrough; the bottom loop-end portion of said lanyard inserted through an ornamental advertising hollow bead/ring naturally forming a secondary smaller loop off-centered on said lanyard, whereas placement of a plurality of hardware clasping mechanisms to secure objects to be displayed on the lower end portion of said lanyard.

2. A lanyard assembly adapted as a cravat holder, comprising a supporting bar, a shirt attaching clasp, secured to said supporting bar, attaching clasp placed off-centered toward the leading end of said supporting bar securing both adjacent ends of the lanyard thus forming a closed loop, allowing for the placement of the cravat therethrough; the bottom loop-end portion of said lanyard inserted completely through an ornamental advertising hollow bead/ring slidably embracing both sides of the lanyard, naturally forming a secondary smaller loop, off-centered on said lanyard, allowing for the left and right adjustment of the lanyard to correctly position the hardware clasping mechanism centered over the cravat.

3. A lanyard assembly adapted as a cravat holder, comprising a supporting bar, a shirt attaching clasp, secured to said supporting bar, attaching clasp placed off-centered toward the leading end of said supporting bar securing both adjacent ends of the lanyard thus forming a closed loop, allowing for the placement of the cravat therethrough; the bottom loop-end portion of said lanyard inserted through an ornamental advertising hollow bead/ring slidably embracing both sides of the lanyard, naturally forming a secondary smaller loop, off-centered on said lanyard, allowing for adjustment, up or down, left or right side of the lanyard straps to correctly position the hardware clasping mechanism attached to the lanyard bottom end-loop by means of an engaging ring of such diameter freely pivot and slide on the lanyard bottom loop-end, allowing for gravity to center the said hardware clasping mechanism over the cravat.

4. The invention as described in claim 1 wherein said shirt attaching clasp, supporting bar, both adjacent ends of the lanyard are permanently assembled or attached to each other, by rivets or adhesives, worn hidden behind the cravat.

5. The invention as described in claim 2 wherein the hollow bead/ring; slidably embracing the lanyard, is variably decorative, with business advertisement logos, signs, or text, concealment achieved by draping the cravat completely over the lanyard, or remain visible over the cravat.

* * * * *